United States Patent [19]

Uekawa et al.

[11] Patent Number: 4,882,758

[45] Date of Patent: Nov. 21, 1989

[54] METHOD FOR EXTRACTING FORMANT FREQUENCIES

[75] Inventors: Yutaka Uekawa, Ashiya; Shuji Takata, Kadoma; Michiyo Goto, Osaka, all of Japan

[73] Assignee: Matsushita Electric Industrial Co., Ltd., Osaka, Japan

[21] Appl. No.: 111,346

[22] Filed: Oct. 22, 1987

[30] Foreign Application Priority Data

Oct. 23, 1986 [JP] Japan ..... 61-252224
Oct. 23, 1986 [JP] Japan ..... 61-252220

[51] Int. Cl.[4] ..... G10L 9/04

[52] U.S. Cl. ..... 381/50; 381/51; 364/513.5

[58] Field of Search ..... 381/29–53; 364/513.5

[56] References Cited

U.S. PATENT DOCUMENTS 3,649,765 3/1972 Rabiner et al. ..... 381/39
4,346,262 8/1982 Willems et al. ..... 381/50
4,486,899 12/1984 Fushikida ..... 381/36
4,536,886 8/1985 Papamichalis et al. ..... 364/513.5 X

*Primary Examiner*—Patrick R. Salce
*Assistant Examiner*—Emanuel T. Voeltz
*Attorney, Agent, or Firm*—Wenderoth, Lind & Ponack

[57] ABSTRACT

A high speed method for formant extraction includes the steps of calculating linear prediction coefficients by executing linear prediction analysis of an input speech signal, extracting a coarse formant frequency by making a linear combination of multiple regression coefficients obtained through multiple regression analysis executed with speech feature parameters taken as predictor variables and with formant frequencies taken as criterion variables and speech feature parameters, and solving a root of an inverse filter formed of the linear prediction coefficients by an approximation method in which the coarse formant frequency is set up as an initial value of the root of the inverse filter and an approximation of root is recursively calculated until it converges to the root.

4 Claims, 5 Drawing Sheets

METHOD FOR EXTRACTING FORMANT FREQUENCIES

BACKGROUND OF THE INVENTION

1. Field of the Invention

The present invention relates to a method for extracting formant frequencies from vowels or voiced consonants of a speech sound.

2. Description of the Prior Art

It is known that the formant frequency is one of the important characteristics of speech sounds such as vowels and voiced consonants. Specifically in the case of identifying a vowel, it is known that it is generally sufficient if a first formant frequency (F1) and a second formant frequency (F2) are known. In order to achieve the extraction of such two formant frequencies using an inexpensive system such as an 8-bit personal computer, a high speed formant extraction method is desired.

FIG. 7 is a processing flow chart in a prior art formant extraction method. In a voice signal input step 11, the voice is stored in a RAM through a microphone and an A/D converter. In a linear prediction coefficient calculation step 12, a p-th degree of linear prediction coefficients for one frame length, for example, of 20 ms is calculated. An inverse filter using linear prediction coefficients is given by $$A(z) = \sum_{K=0}^{p} a_k \cdot z^{-k} \ (a_0 = 1),$$

where $a_1, a_2, \ldots, a_p$ are linear prediction coefficients. A root solving step 40 solves all roots of the filter of an all-zero type by the Newton-Raphson method. The frequency F and the bandwidth B corresponding to a root $z_i$ are obtained by $$F=(f_s/2\pi)\tan^{-1}[I_m(z_i)/R_e(z_i)] \text{ (Hz)} \quad (1)$$

$$B=(f_s/\pi)\ln(z_i) \quad (2)$$

where $f_s$ is the sampling frequency. In a postprocessing step 41, from all the roots obtained in the root solving step 40, roots whose bandwidths B are less than a threshold value or which have continuity in frequency from and to the results in the preceding and following frames are selected, and the lowest frequency root is determined to be the first formant frequency and the next lowest is determined to be the second formant frequency.

In such a method, however, it takes a considerable length of time to obtain the roots, about which an explanation will be given with reference to FIG. 8. FIG. 8 is a flow chart of the operations of the root solving step 40. In step 70, a constant $z_0$ is substituted for $Z_i$ as an initial value of a root candidate. In step 71, $A(z_i)$ and $A'(z_i)$, the linear differential of $A(z_i)$ are calculated. At step 72, a determination is made as to whether or not the absolute value of $A(z_i)/A'(z_i)$, i.e., the difference between the values after renewal and before renewal of $Z_i$ is smaller than a threshold value. If the absolute value is not smaller than the threshold value, $z_i$ is renewed in step 73 and goes back to step 71. But, if the absolute value is smaller than the threshold value, $z_i$ is judged to have converged to a correct root value and is determined to be a root in step 74. Then, in step 75, A(z) is divided by a quadratic expression of $z_i$ and its conjugate complex number $z_i^*$, $(z-z_i)\cdot(z-z_i^*)$, whereby A(z) is renewed. In step 76, a determination is made as to whether or not A(z) has become zero-order, and if it not, the flow returns to step 70 where the calculation to substitute $z_0$ for $z_i$ is performed again. If A(z) is zero-order, the formant frequency and bandwidth are obtained for all roots using the aforementioned equations (1) and (2) in step 77 and the calculation is ended.

In the above described method, since an approximate value of the root is not known at the start, all of the roots are obtained with the same initial value. Hence, the loop from step 76 to step 70 is traversed p/2 times. In order to keep high accuracy even when the desired root is therefore obtained at the later looping, each of the roots obtained must be of high accuracy. Therefore, the threshold value must be made small enough and as a result, the loop 72→73→71 has to be traversed many times. Thus, if such a high volume of calculations is to be performed by an 8-bit personal computer, there arises a difficulty in that the processing time becomes very great and therefore such method is impractical.

SUMMARY OF THE INVENTION

A primary object of the present invention is to provide a high speed formant extraction method.

To achieve the above mentioned object, the formant extraction method of the present invention comprises the steps of: calculating linear prediction coefficients of an input speech signal; extracting a coarse formant frequency by making a linear combination of feature parameters of the speech and multiple regression coefficients of the feature parameter and formant frequency obtained in advance; and solving a root of an inverse filter formed of the linear prediction coefficients by an approximation method in which the coarse formant frequency is set up as an initial value of root of the inverse filter and an approximation of root is recursively calculated until it converges to the root.

The present invention enables the processing time to be reduced by virtue by obtaining the formant frequency through the root solving method in which a calculated coarse formant frequency is set up as the initial value.

DESCRIPTION OF THE PREFERRED EMBODIMENTS

Figure 2:
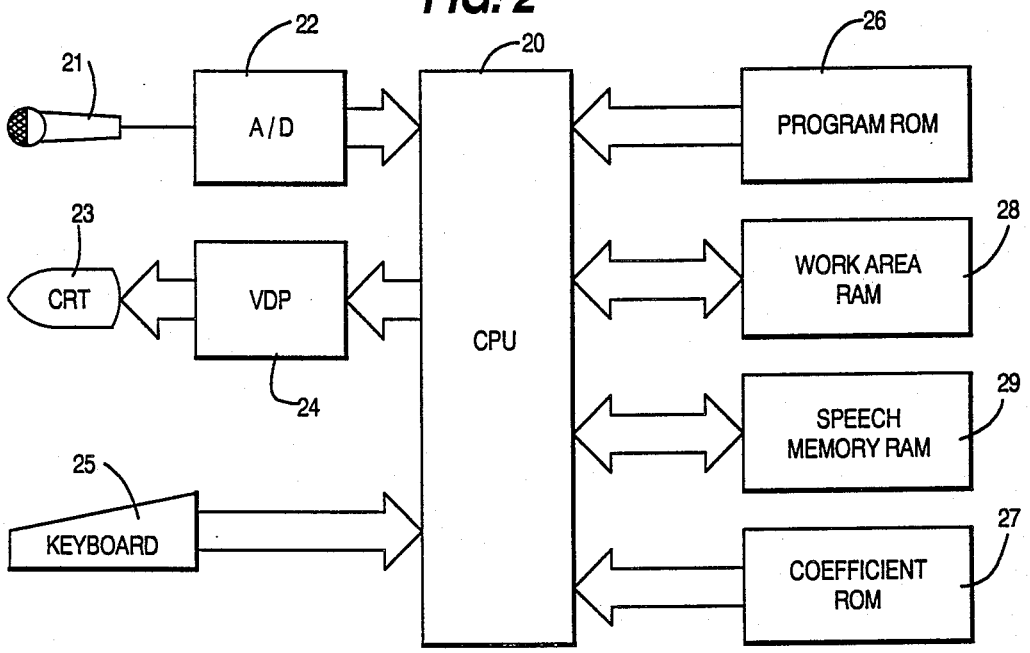
FIG. 2 is a block diagram showing hardware used for performing formant extraction.

FIG. 2 shows a block diagram of hardware used for performing formant extraction. As much hardware, a small computer such as a personal computer may be used. Referring to the figure, element 20 is a CPU; element 21 is a speech input microphone; element 22 is an A/D converter; element 23 is a CRT; element 24 is a video display processor; element 25 is a keyboard; element 26 is a ROM for storing programs; element 27 is a ROM for coefficients; element 28 is a RAM used as a storing work area, and element 29 is a RAM used for speech storage. The microphone 21 is for converting the speech of a speaker to an analog electrical signal. The A/D converter 22 is for converting the analog signal to a digital signal. The CRT 23 is for displaying images for interacting with the speaker. The video display processor (VDP) 24 is for converting data from the CPU 20 to an image signal. The keyboard 25 is for the input of instruction (for example, gender information) from the speaker. The ROM 26 is for storing therein programs for formant extraction. The ROM 27 is for storing various coefficients used in extracting formants. The RAM 28 is a memory for calculation or holding data temporarily. The RAM 29 is for holding input speech data.

Figure 3:
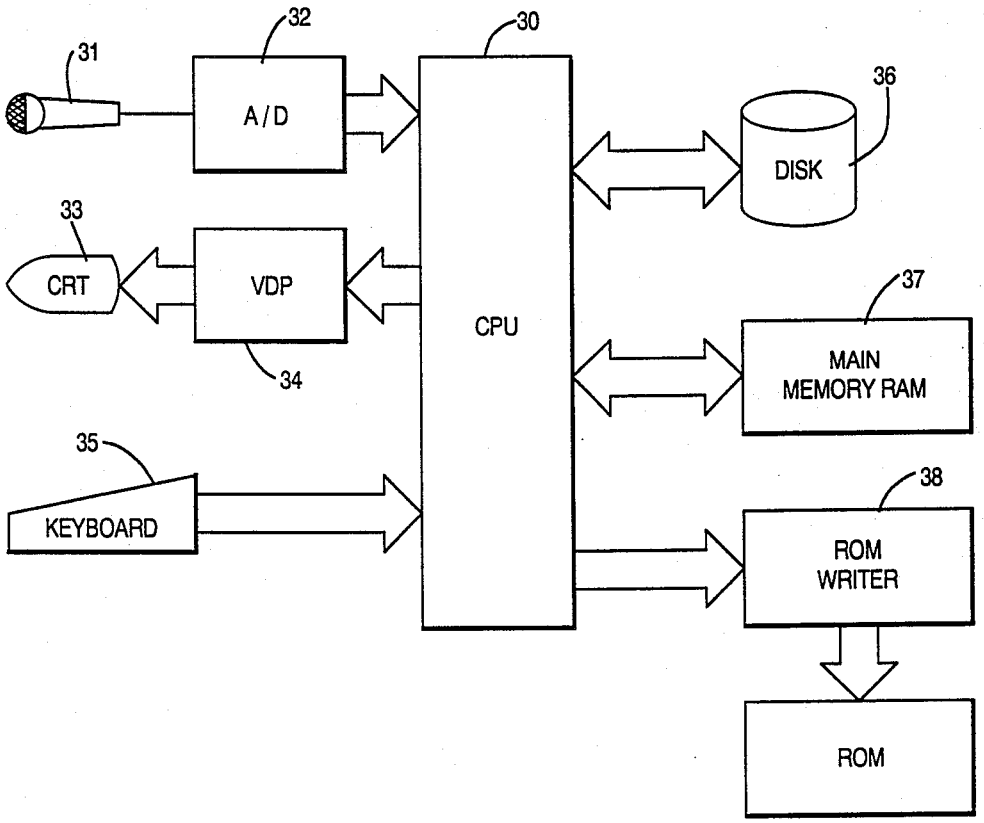
FIG. 3 is a block diagram showing hardware used for calculating formant estimation coefficients for use in formant extraction.

FIG. 3 is a block diagram of the hardware used for calculating the coefficients to be stored in the ROM for coefficients 27 in FIG. 2. As such hardware, a larger-sized computer such as a minicomputer is used. Element 30 is a CPU; element 31 is a speech input microphone; element 32 is an A/D converter; element 33 is a CRT; element 34 denotes a video display processor; element 35 is a keyboard; element 36 is denotes a storage disk; element 37 is a RAM used as a main memory, and element 38 is a ROM writer 38. The CPU 30 is for executing control of the overall hardware. The microphone 31 is for converting speech of a speaker to an analog electrical signal. The A/D converter 32 is for converting the analog signal to a digital signal. The CRT 33 is for displaying images for interacting with the speaker. The video display processor (VDP) 34 is for converting data from the CPU 30 to an image signal. The keyboard 35 is for the input of instruction from the speaker. The disk 36 is a memory for storing various data as files. The RAM 37 is a memory for holding data temporarily. The ROM writer 38 is for writing various coefficients stored in the disk 36 to a ROM used as the ROM 27 in FIG. 2.

Figure 1:
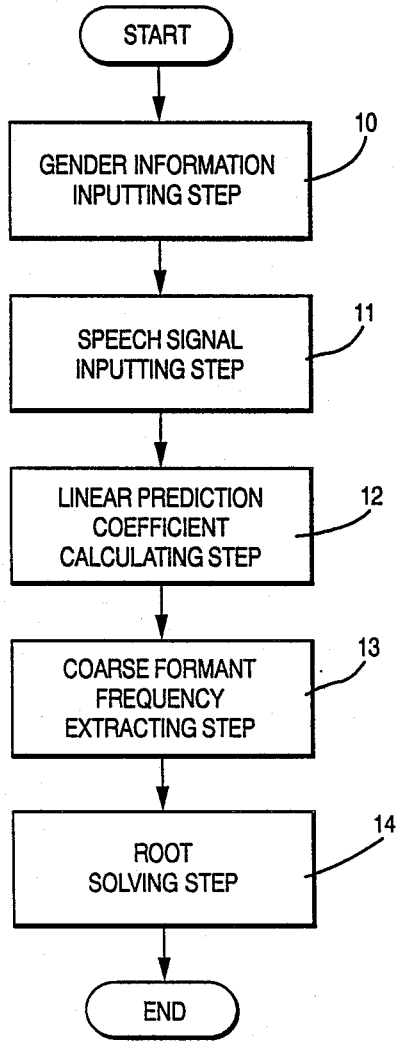
FIG. 1 is a flow chart of a formant extraction method according to an embodiment of the present invention.
Figure 7:
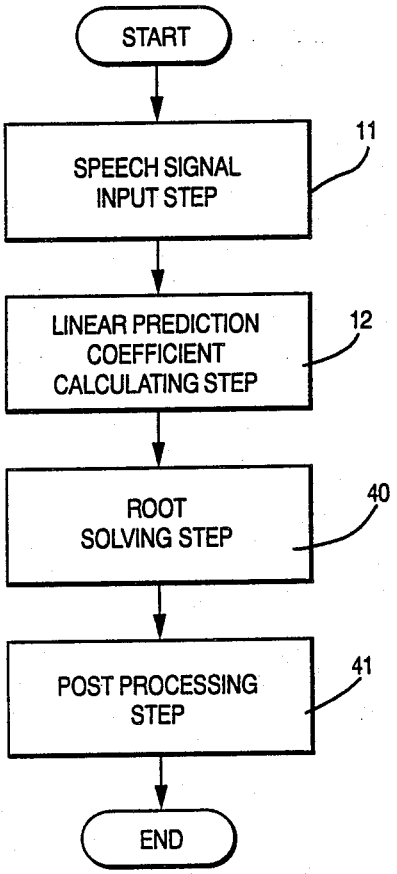
FIG. 7 PRIOR ART
FIG. 7 is a flow chart of a prior art formant extraction method.

Now, the flow chart for the formant extraction method of the present invention as shown in FIG. 1 will be described. Step 10 is a gender information inputting step; element 11 is speech signal inputting step; element 12 is linear prediction coefficient calculating step; element 13 is coarse formant frequency extracting step, and step 14 is root solving step. In the speech signal inputting step 11, the CPU 20 inputs speech into the speech storage RAM 29 through the microphone 21 and A/D converter 22 in accordance with an instruction from the ROM 26. In the linear prediction coefficients calculating step 12, the CPU 20 takes out the speech signal from the RAM 29, processes the speech signal by preemphasis, window and auto-correlation calculations, obtains linear prediction coefficients by the Durbin method, and stores the result in the RAM 28. As the method for obtaining linear prediction coefficients using the Durbin method, a known method, for example, as described in L. R. Rabiner and R. W. Schafer: "Digital Processing of Speech Signals", Prentice-Hall, pp. 411–413, is used.

Figure 4:
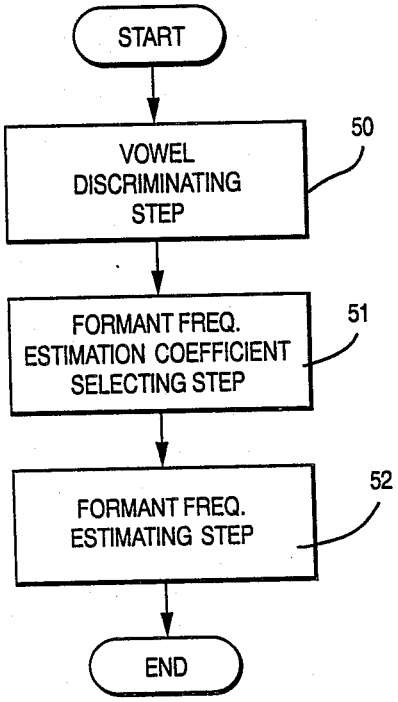
FIG. 4 is a flow chart of an example of the coarse formant frequency extraction method shown in FIG. 1.

A description of an example of the coarse formant frequency extracting step 13 will be made referring to FIG. 4. Step 50 is a vowel discriminating step; step 51 is a formant estimation coefficient selecting step, and step 52 is a formant estimating step. In the vowel discriminating step 50, the linear prediction coefficients loaded in the RAM 28 are sorted into nine vowels (i:, i, e, æ, ʌ, a, ɔ:, u, u:) using vowel discriminant coefficients stored in the ROM 27 and the result is stored again in the RAM 28.

Here, the method for the discrimination of vowels will be explained. Each vowel is first sorted into either of two categories of the nine vowels and then distinguished as a specific vowel.

First, the method for obtaining discriminant coefficients between two categories of vowels used here will be described. After speech data of vowels given by many speakers are stored in the RAM 37 through the microphone 31 and the A/D converter 32, in the FIG. 3 hardware, the linear prediction coefficients thereof are calculated and the results are stored in the disk 36. The number of orders of the linear prediction coefficients here is assumed to be p. The two categories of vowels will here be called group I and group II. We express average vectors and covariance matrixes of the linear prediction coefficients of the group I and group II as $$\mu^{(1)} = \begin{bmatrix} \mu 1^{(1)} \\ \mu 2^{(1)} \\ \cdot \\ \cdot \\ \cdot \\ \mu p^{(1)} \end{bmatrix} \qquad \mu^{(2)} = \begin{bmatrix} \mu 1^{(2)} \\ \mu 2^{(2)} \\ \cdot \\ \cdot \\ \cdot \\ \mu p^{(2)} \end{bmatrix}$$

$$\Sigma_1 = \begin{bmatrix} \sigma\,1\,1(1) & \sigma\,1\,2(1) & \dots & \sigma\,1\,p(1) \\ \sigma\,2\,1(1) & \sigma\,2\,2(1) & \dots & \sigma\,2\,p(1) \\ \cdot & \cdot & \dots & \cdot \\ \cdot & \cdot & \dots & \cdot \\ \cdot & \cdot & \dots & \cdot \\ \sigma\,p\,1(1) & \sigma\,p\,2(1) & \dots & \sigma\,p\,p(1) \end{bmatrix}$$

$$\Sigma_2 = \begin{bmatrix} \sigma\,1\,1(2) & \sigma\,1\,2(2) & \dots & \sigma\,1\,p(2) \\ \sigma\,2\,1(2) & \sigma\,2\,2(2) & \dots & \sigma\,2\,p(2) \\ \cdot & \cdot & \dots & \cdot \\ \cdot & \cdot & \dots & \cdot \\ \cdot & \cdot & \dots & \cdot \\ \sigma\,p\,1(2) & \sigma\,p\,2(2) & \dots & \sigma\,p\,p(2) \end{bmatrix}$$

and set $\Sigma_1=\Sigma_2=\Sigma$. The discriminant function z of the sample $a=(a_1, \dots, a_p)$ of the linear prediction coefficients z can be expressed as $$z=c_1(a_1-\bar{\mu}_1)+c_2(a_2-\bar{\mu}_2)+\dots+c_p(a_p-\bar{\mu}_p)$$

where $$\bar{\mu}_i = (\mu_i^{(1)} + \mu_i^{(2)})/2$$

$$i = 1, \dots, p$$

-continued $$\begin{bmatrix} c_1 \\ c_2 \\ \cdot \\ \cdot \\ \cdot \\ c_p \end{bmatrix} = \Sigma^{-1} \begin{bmatrix} \mu_1^{(1)} - \mu_1^{(2)} \\ \mu_2^{(1)} - \mu_2^{(2)} \\ \cdot \\ \cdot \\ \cdot \\ \mu_p^{(1)} - \mu_p^{(2)} \end{bmatrix}$$

When $z \geqq 0$, a is distinguished as a group I vowel, whereas when $z<0$, a is distinguished as a group II vowel. In deciding at this step whether an input set of linear prediction coefficients belongs to a vowel A or to the remaining eight vowels, if the same is positively decided to belong to the vowel A, the linear prediction coefficients are distinguished as the vowel A. In the case of vowels, the values of the linear prediction coefficients are largely different between male and female speakers. Therefore, data are separated into those for male speakers and those for female speakers, and separate discriminant coefficients are used according to input gender information. The thus obtained discriminant coefficients are written into a ROM, which is used as the ROM 27 in the FIG. 2 hardware, by the ROM writer 38.

In the formant estimation coefficient selecting step 51, the formant estimation coefficients corresponding to the vowel specified in the vowel discriminating step 50 are selected from the ROM 27 and output to the RAM 28.

The method for obtaining the formant estimation coefficients is as follows. Out of linear prediction coefficients for vowel data of many speakers stored in the disk 36, F1 and F2 are obtained. The formant frequencies are obtained by a conventional method. The linear prediction coefficients and F1 as well as F2 are stored in the RAM for the main memory. Representing a known formant frequency about some data of some vowel by F, estimated formant frequency by f, and linear prediction coefficients by $(a_1, a_2, \ldots, a_p)$, we set $$f = d_0 + d_1 \cdot a_1 + d_2 \cdot a_2 + \ldots + d_p \cdot a_p \quad (3)$$

Then, $d_0, d_1, d_2, \ldots, d_p$ represent desired formant estimation coefficients. At this time the estimation error is the difference between F and f. By multiple regression analysis of a large amount of data belonging to the same vowel and made with the linear prediction coefficients taken as the predictor variables and with the estimated formant frequencies taken as the criterion variables, the formant estimation coefficients that will minimize the overall estimation error are obtained and stored in the disk 36. In like manner, the formant estimation coefficients are obtained for all vowels. It is preferable, specifically concerning vowel data, that male voices; and female voices; are separated and that different estimation coefficients are provided for male and female voices. The thus obtained formant estimation coefficients classified by vowels and by sexes are written into the ROM, which is used as the ROM 27, by the ROM writer 38.

In the formant estimating step 52, a coarse formant frequency is estimated by the linear combination of the formant estimation coefficients selected in the formant estimation coefficient selecting step 51 and the linear prediction coefficients. The estimated coarse formant frequency is stored in the RAM 28.

Figure 6:
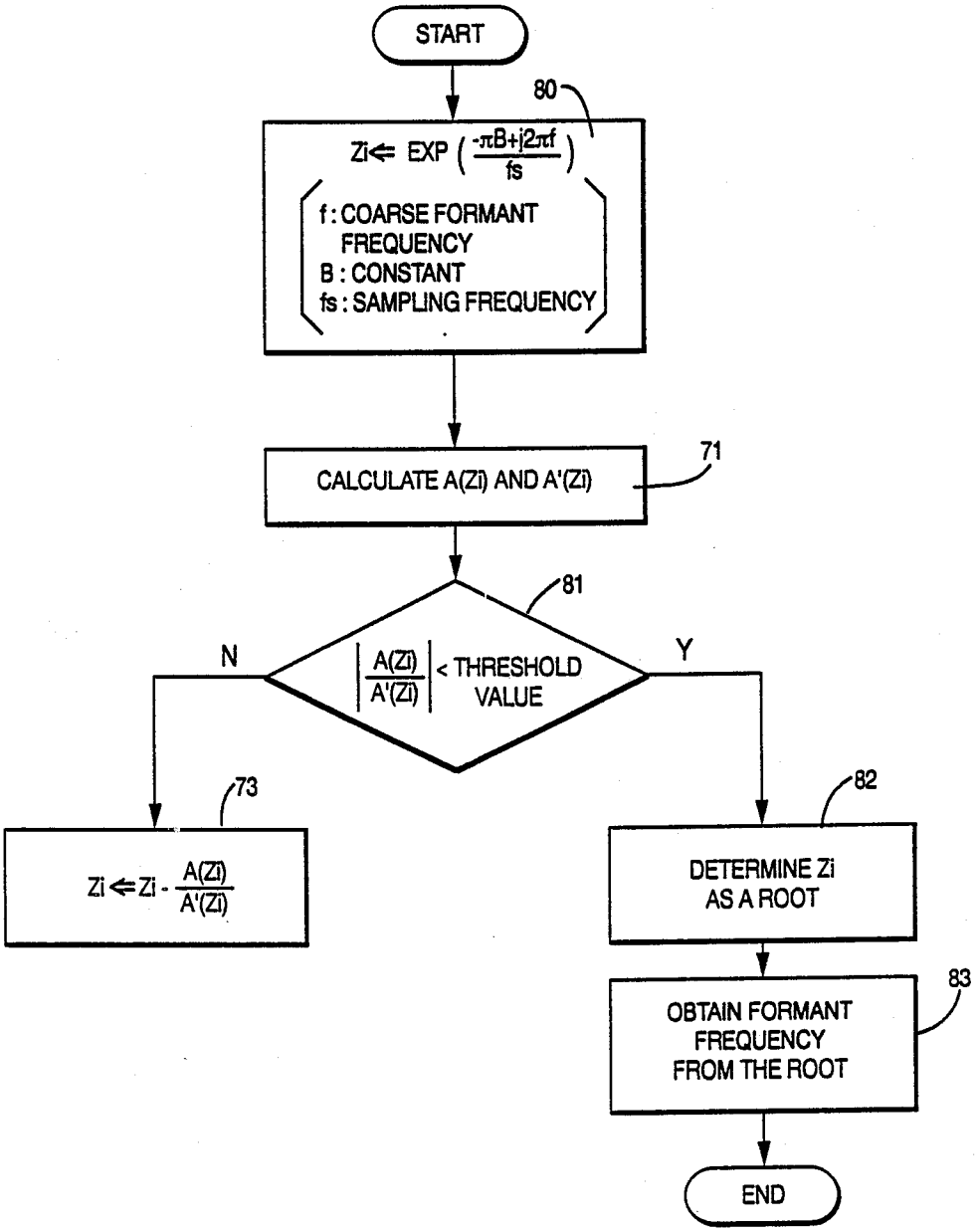
FIG. 6 is a flow chart of the root solving step shown in FIG. 1.
Figure 8:
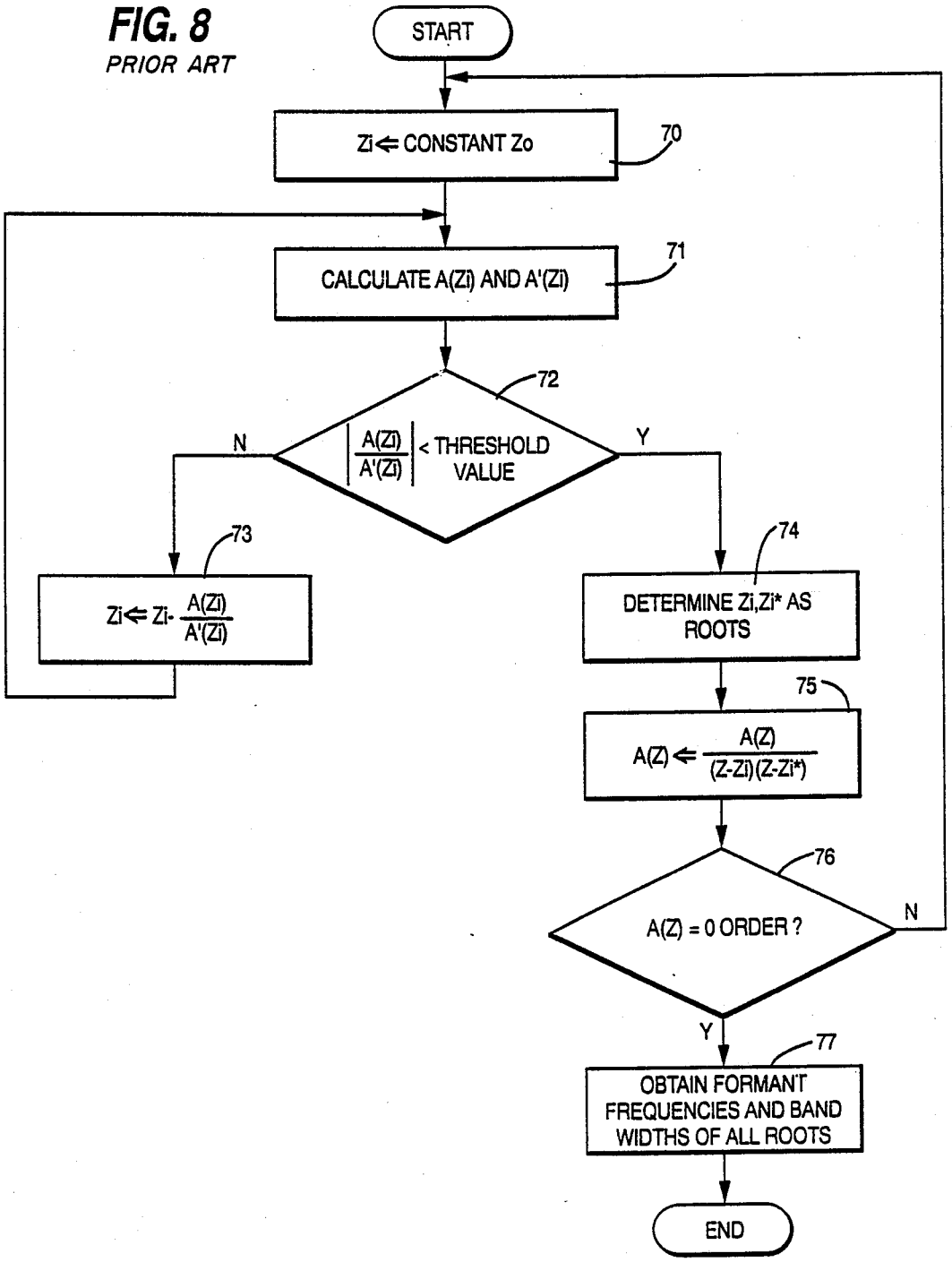
FIG. 8 PRIOR ART
FIG. 8 is a flow chart of the root solving step shown in FIG. 7.

The following is a description of the root solving step 14 using the flow chart shown in FIG. 6. In step 80, as the initial value of $Z_i$, $\exp\{(-\pi B + j2\pi f)/f_s\}$ is provided, where f represents the coarse formant frequency, B represents a suitable constant, and $f_s$ represents the sampling frequency. In step 71, calculations of $A(Z_i)$ and $A'(Z_i)$ are executed. In step 81, a determination is made as to whether or not the absolute value of the difference of $Z_i$ after renewal and before renewal, $A(Z_i)/A'(Z_i)$ is smaller than the threshold value. If the absolute value of the difference is not smaller than the threshold value, $Z_i$ is renewed in step 73 and the flow goes back to step 71. But, if the absolute value of the difference is smaller, $Z_i$ is judged to have converged to a right value of the root in step 82 and is considered to be as the expected root. In step 83, the formant frequency is obtained from this root by using the aforementioned equation (1).

At this time, obtaining the root only for one position is sufficient. Since, further, another root is not required to be obtained, the accuracy needs not be so high. Therefore, the number of times the converging loop (81→73→71) is traversed can be made smaller.

The method of convergence used here is known as the Newton-Raphson method. Even if another method of convergence is used, the calculation speed can of course be made higher by using a coarse formant frequency as the initial value.

So far an example has been shown in which only linear prediction coefficients are used as the feature parameters of speech.

Figure 5:
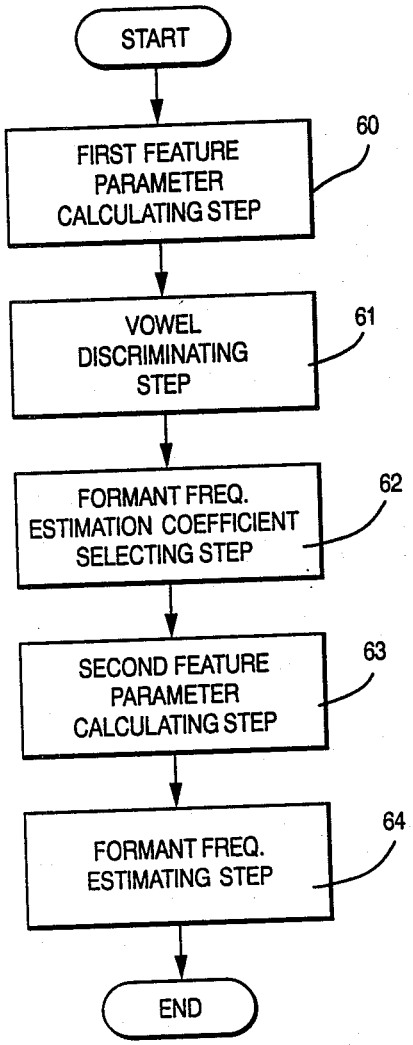
FIG. 5 is a flow chart of another example of the coarse formant frequency extraction method shown in FIG. 1.

The following is a description of a second example of a procedure for the coarse formant frequency extracting step 13 with reference to FIG. 5. Step 60 is a first feature parameter calculating step; step 61 is a vowel discriminating step; step 62 is a formant estimation coefficient selecting step; step 63 is a second feature parameter calculating step, and step 64 is a formant estimating step. The first feature parameters and the second feature parameters are the feature parameters indicating the form of the speech spectrum. The same can be any of linear prediction coefficients, LPC cepstrum coefficients, PARCOR coefficients, and Log Area Ratio coefficients. For particulars of these feature parameters, refer, for example, to L. Rabiner and R. W. Schafer: "Digital Processing of Speech Signals", Prentice-Hall, pp. 442–444. A band-pass filter bank output may also be used as the feature parameters.

In the first feature parameter calculating step 60, the first feature parameters are obtained from the speech data stored in the RAM 29 and stored in the RAM 28. In the vowel discriminating step 61, the first feature parameters stored in the RAM 28 are sorted into the nine vowels (i:, i, e, æ, ʌ, a, ɔ, u, u:) using vowel discrimination coefficients stored in the ROM 27 and the result is stored again in the RAM 28. The method for vowel discrimination is the same as in the above described case with the linear prediction coefficients.

In the formant estimation coefficient selecting step 62, the formant estimation coefficients corresponding to the vowel specified in the vowel discriminating step 61 are selected from the ROM 27 and stored in the RAM 28. The formant estimation coefficients used here are obtained from the second feature parameters in advance in the same way as were obtained from the linear prediction coefficients in the first embodiment.

In the second feature parameter calculating step 63, the second feature parameters are obtained from the speech data stored in the RAM 29 and restored in the RAM 28.

In the formant estimating step 64, the coarse formant frequency is estimated by the linear combination of the formant estimation coefficients selected in the formant estimation coefficient selecting step 62 and the second feature parameters, such as $$f=d_0+d_1 \cdot b_1+d_2 \cdot b_2+ \ldots +d_p \cdot b_p \quad (4)$$

where ($b_1$, $b_2$, . . . , $b_p$) are the second feature parameters. The estimated coarse formant frequency is stored in the RAM 28.

So far, the cases where the formant frequencies of vowels are obtained have been described, but those of voiced consonants can be obtained by executing appropreate speech category decisions instead of the above mentioned vowel discrimination. The third or further formant frequencies can be obtained in the same way as described above.

What is claimed is:

1. A method for extracting a formant frequency comprising the steps of:

calculating linear prediction coefficients by linear prediction analysis of an input speech signal;

extracting a coarse formant frequency by a linear combination of feature parameters of speech obtained by calculation from the speech input signal and previously prepared coefficients; and solving a root of an inverse filter formed of the linear prediction coefficients by an approximation method in which the coarse formant frequency is used as an initial value of a root of the inverse filter and an approximation of a root is recursively calculated until it converges to the root.

2. The method for extracting a formant frequency according to claim 1, wherein said step for extracting a coarse formant frequency comprises first and second speech feature parameter calculating steps for respectively executing sound analysis of a speech input signal to calculate first and second feature parameters representing a spectrum envelope, a speech category deciding step for determining a category of said input speech signal according to said first speech feature parameters, a formant estimation coefficient selecting step for a selecting multiple regression coefficients which correspond to the speech category obtained as a result of said speech category decision from multiple regression coefficients obtained in advance through multiple regression analysis of input speech signals from many speakers executed for each speech category with the second feature parameters taken as predictor variables and with formant frequencies taken as criterion variables, and a formant estimating step for making a linear combination of the selected regression coefficients and said second feature parameters.

3. A method for extracting a frequency comprising the steps of;

calculating linear prediction coefficients by linear prediction analysis of an input speech signal;

extracting a coarse formant frequency by making a linear combination of the linear prediction coefficients and previously prepared formant estimation coefficients; and solving a root of an inverse filter formed of the linear prediction coefficients by an approximation method in which the coarse formant frequency is used as an initial value of a root of the inverse filter and an approximation of a root is recursively calculated until it converges to the root.

4. The method for extracting a formant frequency according to claim 3, wherein said step for extracting a coarse formant frequency comprises a speech category deciding step for determining a category of the input speech signal according to the linear prediction coefficients, a formant estimation coefficient selecting step for selecting multiple regression coefficients which correspond to the speech category obtained as a result of said speech category decision from multiple regression coefficients obtained in advance through multiple regression analysis of input speech signals from many speakers executed for each speech category with linear prediction coefficients taken as predictor variables and with formant frequencies taken as criterion variables, and a formant estimating step for making a linear combination of the selected regression coefficients and the linear prediction coefficients.

* * * * *